United States Patent [19]

Brown

[11] 4,130,364

[45] Dec. 19, 1978

[54] METHOD AND PORTABLE APPARATUS FOR TREATING ASPHALT PAVING MATERIAL

[76] Inventor: Ralph E. Brown, 7428 Kingsway Dr., Fort Wayne, Ind. 46819

[21] Appl. No.: 791,717

[22] Filed: Apr. 28, 1977

[51] Int. Cl.[2] ..... B28C 5/20; B28C 5/42; B01F 15/06; B01F 9/06

[52] U.S. Cl. ..... 366/4; 366/12; 366/25; 366/57; 366/105; 366/145; 366/228; 366/230; 366/233; 366/606

[58] Field of Search ..... 259/3, 14, 30, 81 R, 259/88, 145–148, 150, 151, 158, 160, 161, 169, 172–175, 177 R; 366/3, 4, 12, 25, 14, 54, 225, 228, 230, 57, 105, 145, 233, DIG. 606

[56] References Cited

U.S. PATENT DOCUMENTS

| | | | |
|---|---|---|---|
| 954,285 | 4/1910 | Heinberg | 259/175 |
| 2,188,798 | 1/1940 | Smith | 259/151 |
| 2,924,513 | 2/1960 | Altimier | 259/175 |
| 2,959,869 | 11/1960 | Ackerman | 259/81 R |
| 3,407,511 | 10/1968 | Camm | 259/3 |
| 3,674,242 | 1/1971 | Stewart | 259/158 |
| 3,693,945 | 9/1972 | Brock | 259/146 |
| 3,737,149 | 6/1973 | Muntzer | 259/146 |
| 3,840,215 | 10/1974 | McConnaughay | 259/158 |
| 3,866,888 | 2/1975 | Dydzk | 259/3 |
| 3,940,120 | 2/1976 | Miller | 259/158 |
| 3,950,861 | 4/1976 | Weimer | 259/151 |
| 4,039,171 | 8/1977 | Shearer | 259/158 |

*Primary Examiner*—Harvey C. Hornsby
*Assistant Examiner*—Timothy F. Simone
*Attorney, Agent, or Firm*—John F. Hoffman; Albert L. Jeffers

[57] ABSTRACT

A method and apparatus for treating paving material wherein the asphalt material is tumbled within an inclined drum so that it initially passes through the center portion of a stream of hot gases and is conveyed rearwardly and then is subsequently dropped through a more peripheral portion of the hot gas stream and conveyed rearwardly at a faster rate than it was initially. The apparatus comprises a wheeled frame, an elongated drum having a cylindrical inner surface and which is supported on the frame for rotational movement about its longitudinal axis, a feed chute communicating with the inlet end of the drum, and LP gas burners mounted at the opposite end of the drum so as to direct a flame and stream of hot gas centrally through a drum toward the inlet. A plurality of flights are secured to the drum inner surface which extend radially inward toward the drum longitudinal axis and extend rearwardly in a direction parallel to the axis. A second plurality of elongated flights are also secured to the drum inner surface rearwardly of the first mentioned flights and are inclined relative to the radial and longitudinal axes such that the paving material is advanced rearwardly at a faster rate without being dropped through the hottest portion of the hot gas stream.

34 Claims, 15 Drawing Figures

METHOD AND PORTABLE APPARATUS FOR TREATING ASPHALT PAVING MATERIAL

BACKGROUND OF THE INVENTION

The present invention relates to portable apparatus for mixing and heating asphalt paving material and for recycling asphalt paving material which has been removed from a road surface.

Asphalt is widely used today as a road surfacing material and in other vehicular supporting applications such as parking lots and driveways. One of the primary reasons for the widespread use of asphalt is the relative ease with which it may be repaired particularly in the winter months when road deterioration is greatly accelerated. As is well recognized by any motorist, many potholes develop on asphalt roads during the winter due to the continuous freezing and thawing cycle. This causes the road surface to buckle or collapse thereby breaking up the asphalt layer which is then knocked loose by passing vehicles.

In general, asphalt paving material comprises an aggregate which is crushed and then mixed with asphalt or other suitable bituminous material which serves the function of the binder. When the binder is heated, it softens and becomes sticky, thereby permitting the aggregate to flow and forms a mixture which will adhere to the substrate.

One type of asphalt material often used for patching purposes is cold mix which is able to be laid in a cold state as opposed to hot mix which must be laid in a heated condition. It is common practice for the cold mix to be premixed at a central plant in advance and then stockpiled for use as a patching material at a later time.

In order to prevent the cold mix from becoming hard and unworkable in the stockpile especially during the winter months, the asphaltic cement is diluted with various petroleum based distillates such as kerosene or fuel oil. Although dilution is necessary to enable the cold mix to be worked, it is deleterious to the asphalt bonding quality and the various distillates must be evaporated before the patch has the same adhering and cementing qualities of the regular asphalt road surface. One problem which is quite prevalent is that of the patch mixture being tracked away from the required area by passing vehicles before enough of the diluting additives evaporate to allow the asphalt to again become a cementing agent capable of holding the aggregate particles together. Additionally, water in the repaired area frequently causes the asphalt to float out of the mix and leave uncemented aggregate behind. As more distillates are added to the asphaltic cement, the curing time increases and the water resistant qualities decrease thereby aggravating the above problems.

Additionally, a cold mix patch that does manage to cure sufficiently to stay in place during the cold weather months, often has heavy distillate additives trapped below the surface. Many of these patches tend to soften under the higher temperatures of the summer months thereby causing the material to become plastic and flow out of the repaired area.

In order to permit the asphaltic cement to regain its adhesive and bonding characteristics, the asphalt mixture is heated thereby driving off the diluting additives. This presents a problem of its own, however, since the boiling points for many of the additives are in the range of 550° to 700°, which is sufficiently high to cause the asphalt to oxidize rapidly and even burn. In fact, the asphalt will flash at a temperature of approximately 425° if there is a sufficient supply of oxygen. As will be described in greater detail hereinafter, the present invention prevents the oxidation or burning of the asphalt material within the drum by maintaining a relatively low oxygen level therein. Even if the oxygen content within the drum is controlled, the asphalt may flash when it exits from the drum because at this point it is exposed to an open flame and to a relatively high oxygen content atmosphere. For this reason, it is necessary that the temperature of the aggregate particles and asphaltic coating be controlled by accurately regulating the heating and the amount of time which the mixture remains within the drum. Avoiding direct contact between the material and the flame and rapidly discharging the material from the rear of the drum are also necessary to avoid oxidation.

In reclaiming and recycling asphalt pavement material, it is usually removed in relatively large chunks which must be substantially reduced in size either before or during the heating treatment. If the chunks are insufficiently broken up when they are discharged from the processing apparatus, the asphalt binder will not have softened and the material will not be sufficiently fluid and pliable to be spread. Also, the material will not have the adhesive and binding properties which are necessary to the formation of a satisfactory patch. On the other hand, if the larger chunks are heated through until the center has reached the proper temperature, the surface will most likely have been overheated so that it may catch fire either within the drum or as it is discharged onto the pavement.

Apparatus for heating and mixing asphalt patching material are generally known. One example of such apparatus is disclosed in U.S. Pat. No. 3,674,242 which comprises an inclined rotating drum having a plurality of longitudinally extending fins which serve to tumble the cold mix so that it is dropped through the stream of hot gas produced by an LP burner and simultaneously conveyed rearwardly. Since both the front and rear fins are radially oriented, the asphalt material is dropped through the hottest portion of the flame the entire length of the drum right up to the point where it is discharged. This often results in the material being overheated such that it oxidizes or flashes. If the flame intensity is reduced to prevent this situation, there is the danger that portions of the material will not be heated through sufficiently. U.S. Pat. Nos. 2,487,887 and 2,305,938 also relate to asphalt mixing and heating apparatus and although the mixing fins are angled in the direction of material flow, they extend inwardly from the drum surface in a radial direction. Furthermore, all of the fins are angled in this manner so that the material is advanced at the same rate regardless of its distance from the flame.

The prior art also fails to provide means whereby the larger chunks of asphalt material are broken up sufficiently before being discharged. As discussed earlier, this is an important factor in assuring that all the asphalt material is heated to the optimum temperature without oxidizing or burning the asphalt coating of the individual particles or chunks.

SUMMARY OF THE INVENTION

The present invention overcomes the deficiencies discussed above by providing an asphalt mixing and heating machine wherein the fins near the inlet end of the drum, which are the furthest from the flame source, are oriented radially and parallel to the drum axis. This causes the asphalt material to be raised and dropped through the center of the drum and accordingly through the longest path and the hottest portion of the hot gas stream at that particular longitudinal position. The rear flights, on the other hand, are angled downwardly away from the direction of rotation in a radial sense and are also angled downwardly away from the direction of rotation in a longitudinal sense. This causes the material to be dropped from one flight to the next near the periphery of the drum so that it does not come into direct contact with the flame or the hottest portion of the hot gas stream. This also causes the material to be conveyed rearwardly at a faster rate so that overheating is prevented.

By holding the material within the drum for a longer period of time at a point further removed from the flame source, more uniform and complete heating may be achieved without subjecting the particles to very intense heat which may cause oxidation and burning. The longer period of time at or near the optimum temperature also permits many of the diluting distillates to be driven off so that the material has regained its original cementing qualities. At this time, the material is conveyed more rapidly to the rear without coming into direct contact with the flame and is then discharged.

More specifically, the present invention is concerned with portable apparatus for treating paving material comprising: a wheeled frame; an elongated drum having a cylindrical inner surface, an inlet at the forward end and an outlet at the opposite rear end thereof, and being supported on the frame with its longitudinal axis extending lengthwise of the frame; means carried by the frame for rotating the drum in a given direction about its longitudinal axis; material feed means communicating with the inlet; burner means mounted at the drum outlet for directing a stream of hot gases centrally through the drum toward the forward end; means comprising a plurality of first flights secured to the drum inner surface for raising paving material from the lower portion of the drum and then dropping it through the stream of hot gas at a first radial distance with respect to the drum axis while at the same time conveying the material rearwardly at a first rate as the drum rotates; and means comprising a plurality of second flights secured to the drum inner surface rearwardly of the first flights for raising paving material from the lower portion of the drum and then dropping it through the stream of hot gas at a second radial distance with respect to the drum longitudinal axis, this distance being greater than the first radial distance, while at the same time conveying the material rearwardly at a faster rate than the first rate.

The present invention is also concerned with a method for recycling old asphalt paving material which comprises: removing the old asphalt paving material from a road surface or the like, providing a stream of hot gases capable of softening the removed asphalt material, tumbling the asphalt so that it passes through the center portion of the hot gas stream while at the same time conveying the asphalt material generally toward the source of the hot gases at a first rate, subsequently tumbling the asphalt material so that it drops at a more peripheral location of the drum and at the same time conveying the material generally toward the source of the hot gases at a faster rate than the first rate, and discharging the softened asphalt material on a storage tray or directly on the road surface which is to be patched or paved.

By means of the above apparatus, the recycled paving material will be broken up into relatively small particles and the asphaltic cement which forms a coating on the outside of the particle will be heated and becomes fluid as the aggregate particles are simultaneously brought up to the desired temperature.

In the case of cold mix materials, the various diluting additives are driven off from the asphalt coating the surface of the particles while in the drum and since the coating accounts for a relatively small percentage of the total mass of the particle, it will cool down somewhat prior to being discharged. Therefore, even though the temperature of the asphalt may be sufficiently high to cause it to burn in an oxygen rich environment, heat transfer from the external surface to the cooler interior of the particle will reduce its temperature to the point where it will not burn upon discharge.

It is an object of the present invention to provide a method and apparatus for treating paving material which includes an inclined rotating drum having internal flights which rapidly pull the material into the drum from the feed chute, drop the material through the hottest portion of the hot gas stream while slowly advancing it toward the discharge outlet, and then rapidly advancing it through the flame zone without dropping it through the flame itself.

It is also an object of the present invention to provide a method and apparatus for treating asphalt paving material having a substantially sealed heating chamber with a controlled atmosphere so as to enable sufficient heating of the material without causing it to oxidize or burn.

A further object of the present invention is to provide a method and apparatus for treating asphalt paving material having a comminuting zone comprising a rotating grizzly which abrades and breaks up large chunks of recycled material and prevents their being conveyed to the discharge outlet but does not impede the flow of particle-size material.

Another object of the present invention is to provide a method and apparatus for treating asphalt paving material which drops larger chunks of recycled material through the hottest portion of the hot gas stream until they are sufficiently reduced in size to be conveyed toward the discharge outlet.

Another object of the present invention is to provide a method and apparatus for treating asphalt paving material wherein replaceable sharpened spikes projecting inwardly from the mixing drum assist in breaking up large chunks of recycled asphalt.

Yet another object of the present invention is to provide a method and apparatus for treating asphalt paving material including heat sensing means mounted so as to monitor the temperature of the exhaust gases and modulate the gas supply to the burners.

A further object of the present invention is to provide a method and apparatus for treating asphalt paving material including a shroud for the rotating drum to thereby conserve heat and prevent the operator from being accidentally burned.

A still further object of the present invention is to provide a method and apparatus for treating paving material including a continuously burning pilot for lighting the main burners and maintaining residual heat in the drum when the main burners are shut off.

These and other objects of the present invention will be apparent from the following description of the preferred embodiment considered together with the accompanying drawings.

DESCRIPTION OF THE PREFERRED EMBODIMENT

Figure 4:
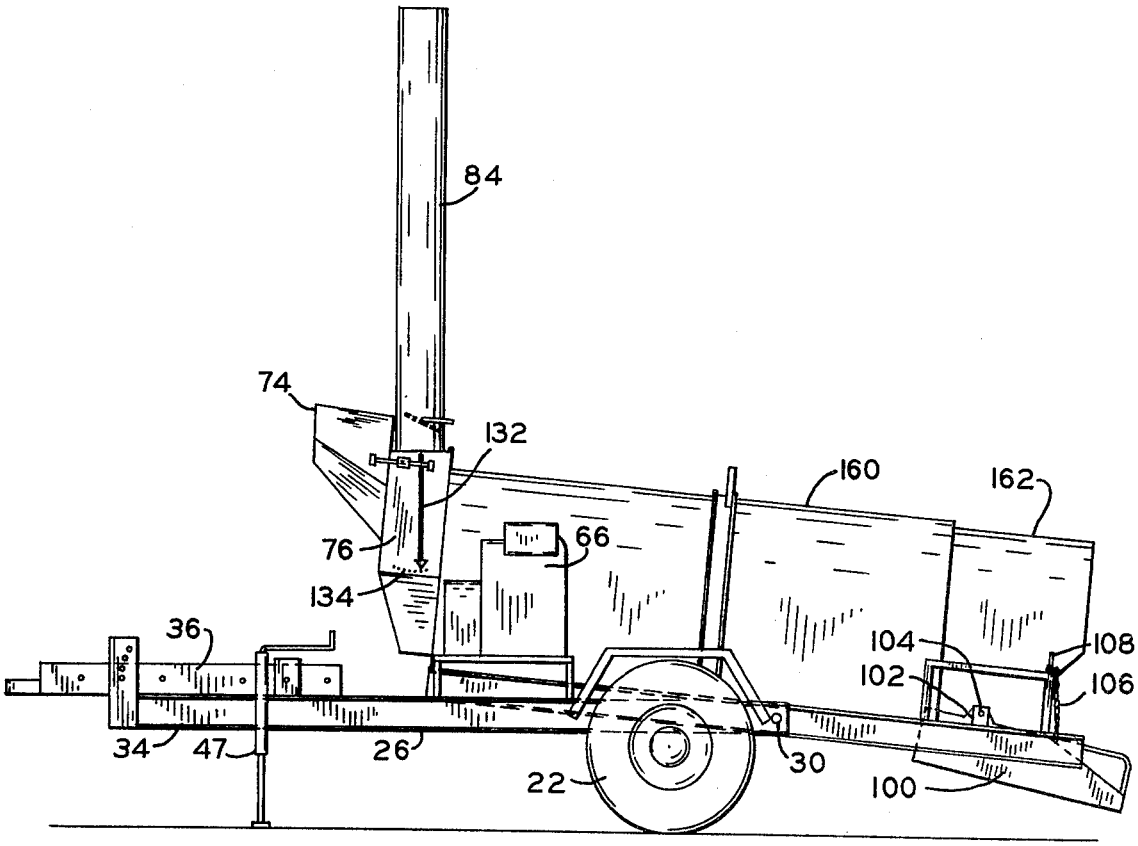
FIG. 4 is a less detailed side elevational view of the apparatus shown in its tilted position.

Referring now to the drawings, the apparatus according to the present invention comprises a frame or chasis 20 supported on a pair of wheels 22 and 24. The frame 20 includes two main rigid sections 26 and 28 wherein section 26 is supported on wheels 22 and 24 and section 28 is pivotally secured to section 26 by means of full width hinge 30 so that it is capable of tilting action as shown in FIG. 4. As will be observed, frame sections 26 and 28 are generally U-shaped and open in the rearward direction. Frame section 26 includes a yoke portion 34 to which is attached a hitch 36 adapted to be engaged by a complementary hitch on the towing vehicle.

The hitch 36 is adjustably connected to yoke 34 by a sliding-pivot arrangement including a vertical adjusting bracket 38 and a horizontal adjusting bracket 40. By means of pins which pass through openings 42 in bracket 38, openings 44 in tongue 36 and opening 46 in bracket 40, the tongue can be raised or lowered and moved longitudinally so as to adjust to the hitch height of different trucks and the longitudinal adjustment feature enables the spacing between the rear of the truck and the mixing apparatus to be varied. The adjustable hitch feature also permits the drum to be tilted to various angles independently of the tilting angle between frame sections 26 and 28 as in the case where the road grade is unusually steep. A jack stand 47 is provided for supporting the chassis 20.

In order to tilt inner frame section 28 with respect to outer frame 26, a crank operated jack 48 having a crank 50 is mounted between frame sections 26 and 28. As crank 50 is rotated one direction or the other, the front end of frame section 28 will be raised or lowered with respect to frame 26.

Figure 5:
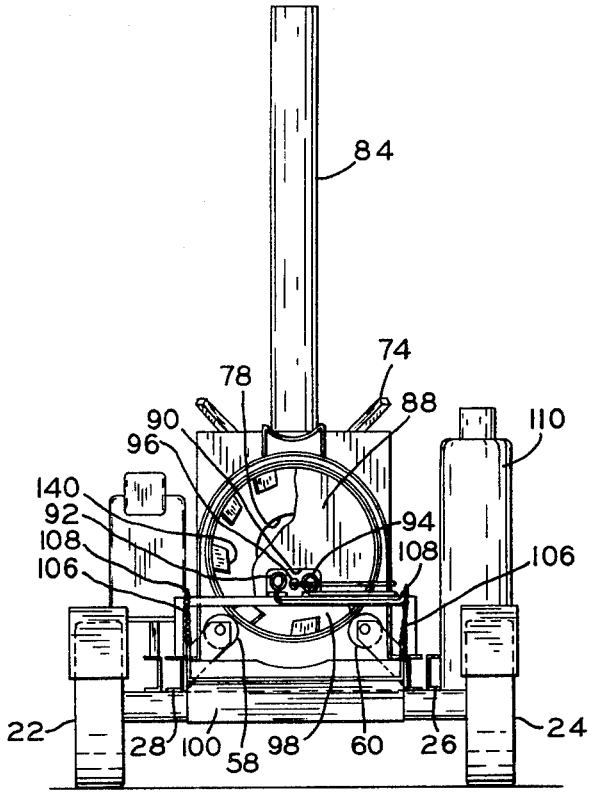
FIG. 5 is a rear end view of the apparatus.

Mounted on frame section 28 is a hollow cylindrical drum 52 having its longitudinal axis parallel to the longitudinal axis of frame 20. Drum 52 is provided with a pair of drive rings 54 and 56 which are rigidly secured thereto and which encircle the drum as shown in FIG. 5. Drive rings 54 and 56 are supported for rotation on two pairs of trunnion rollers 58, 60 and 62, 64. Rollers 58, 60, 62 and 64 are driven by means of gasoline powered engine 66 and chain and sprocket driven drive shafts 68 and 69 and in turn drive drum 52 in rotation in a clockwise direction as viewed in FIG. 5. Additional rollers (not shown) may engage the forward drum flange 70 to prevent its shifting longitudinally. Control lever 72 is operatively connected to the clutch mechanism of engine 66 through arm 74 and is positioned such that it can be operated at the rear of the machine.

Figure 6:
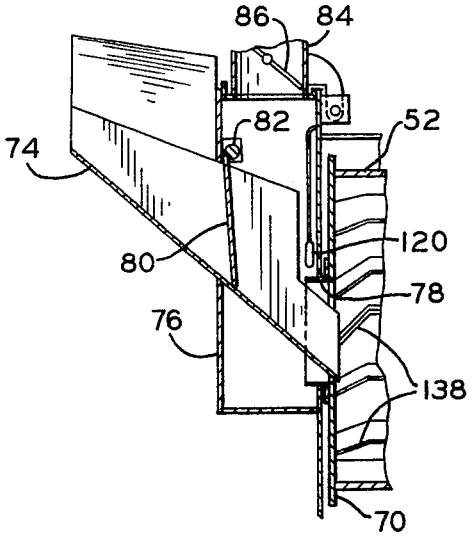
FIG. 6 is a fragmentary sectional view of the feed chute and forward end of the mixing drum.
Figure 7:
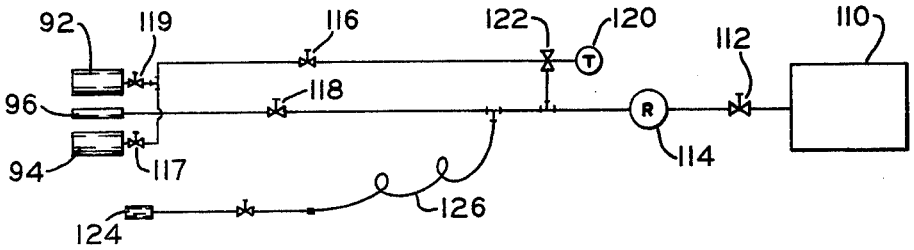
FIG. 7 is a schematic representation of the gas supply system for the burners.

At the forward end of drum 52, is a feed chute 74 which extends through inlet box 76 into the opening 78 in the drum forward flange plate 70 as best shown in FIG. 6. As will be noted, the forward end of drum 52 is nearly completely sealed by means of inlet box 76 and a gravity closed door 80 having an adjustably balanced handle 81 which cooperates with feed chute 74. As material is dumped into chute 74, door 80 will open about its hinges 82 and then immediately closes after the material has passed. A stack 84 is hingedly mounted to inlet box 76 so that it can be folded horizontally to the position shown in FIG. 1 when the apparatus is in transit. Stack 84 is also provided with a damper 86 for draft control. As shown in FIG. 4, the stack will be substantially vertical when the apparatus is tilted rearwardly in the operating position. Damper 86 is important from the standpoint of adjusting the flow of oxygen into drum 52 so that oxidation and burning of the asphalt material is prevented.

Turning now to the rear portion of the apparatus, drum 52 is partially enclosed by a rear cover plate or shroud 88 having an opening 90 for main burners 92 and 94 and pilot burner 96. The lower portion of drum 52 is not covered by plate 88 so as to provide a discharge opening 98 for the asphalt material.

Figure 1:
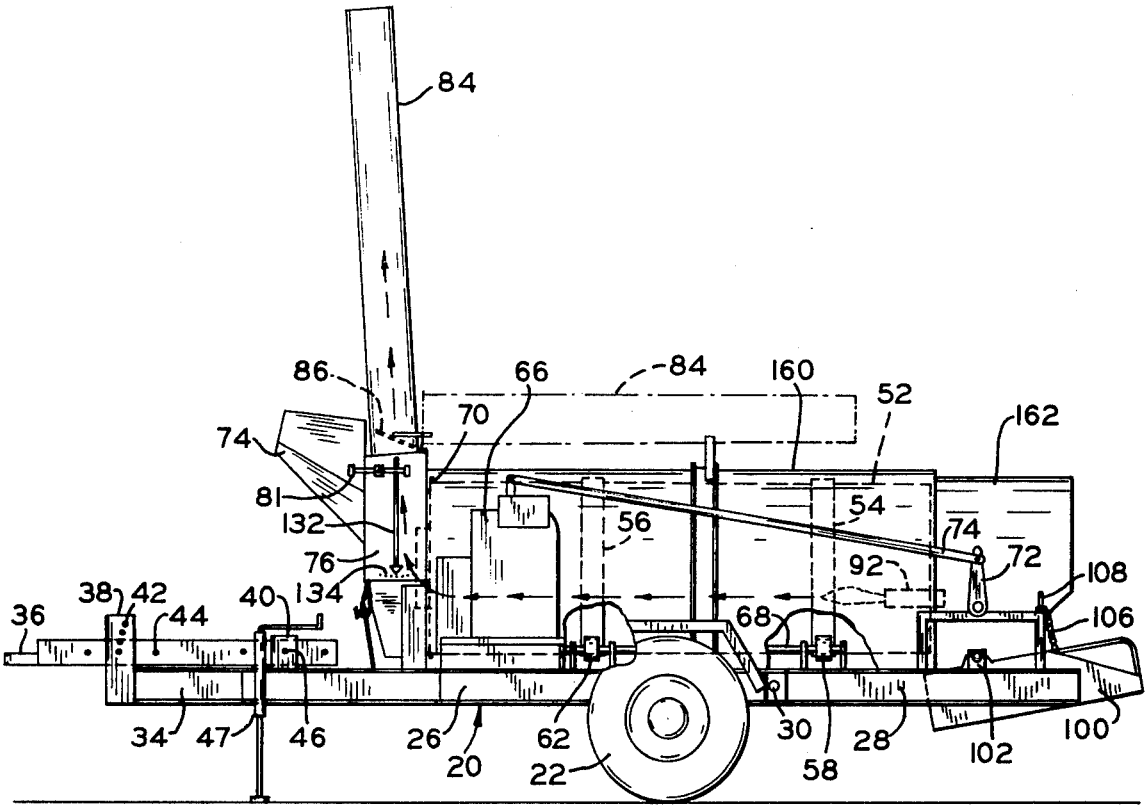
FIG. 1 is a side elevational view of a portable asphalt mixing apparatus according to the present invention.
Figure 2:
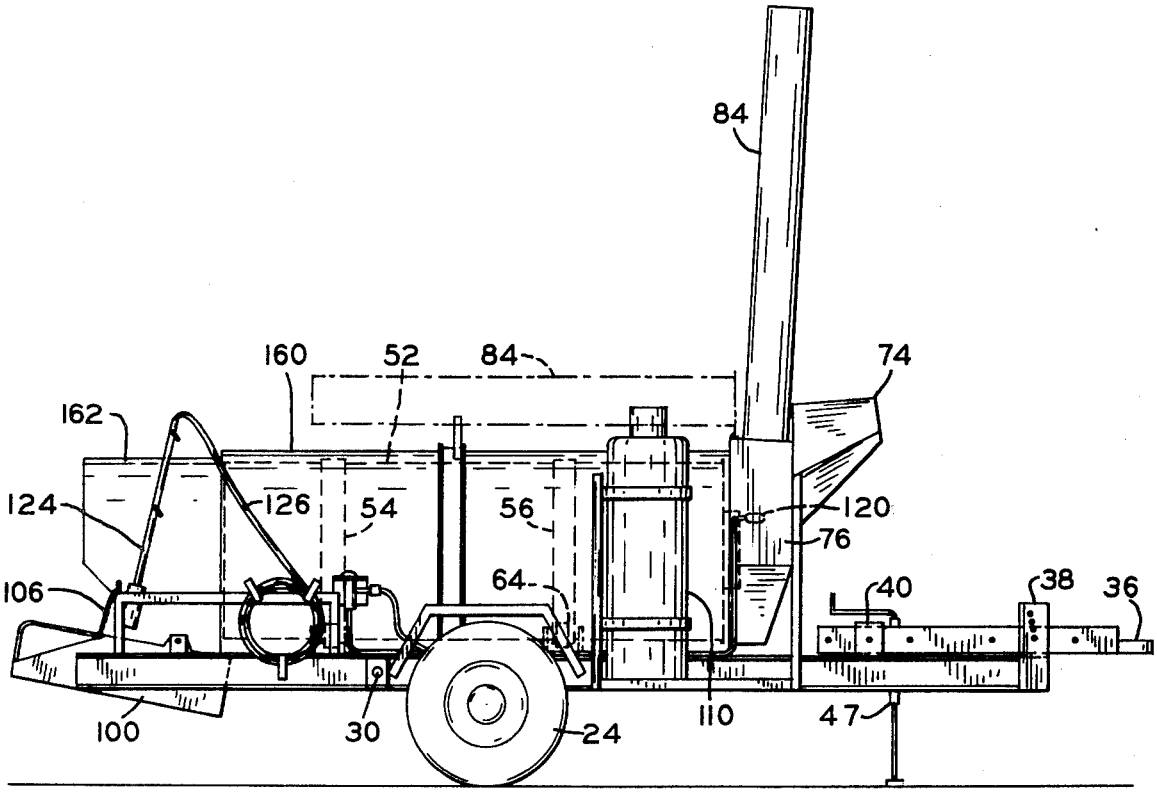
FIG. 2 is a side elevational view of the apparatus as viewed from the opposite side.
Figure 3:
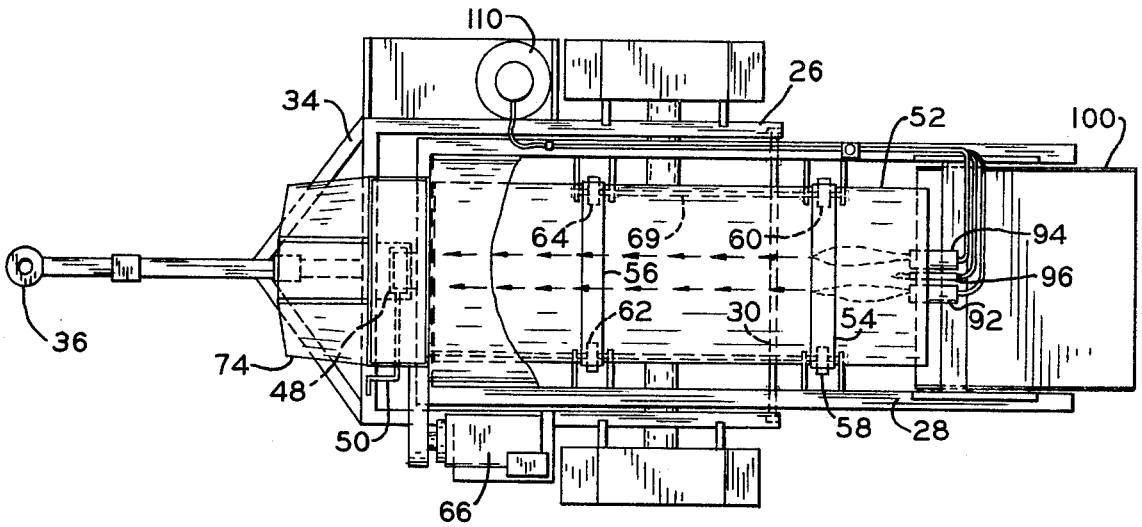
FIG. 3 is a top plan view of the apparatus with the shrouds removed.

A discharge tray 100 is pivotally supported on frame 28 by means of brackets 102 and pins 104 and is adapted to be suspended in a selected tilted position by means of chains 106 and posts 108. By these means, tray 100 may be tilted downwardly as shown in FIG. 4 during asphalt material discharge and upwardly as shown in FIGS. 1 and 2 while in transit.

The LP gas supply for burners 92, 94 and 96 comprises storage tank 110, main shut off valve 112, regulator 114, main burner shut off valve 116, main burner control valves 117 and 119 and pilot valve 118. In order to regulate the temperature within drum 52, the apparatus is provided with a mercury-type temperature sensor 120 which is operatively connected to automatic gas modulating valve 122 which is connected between tank 110 and main burners 92 and 94. This serves to monitor the temperature of the exhaust gases which exit through inlet box 76 and either increase or decrease the flow of gas to burners 92 and 94 so that the temperature is maintained within set limits. The apparatus is also provided with a hand-held torch 124 which is connected to the gas supply through a length of hose 126. The torch 124 may be used to melt ice and snow and to heat the pavement areas which are to be patched when conditions are extreme.

Referring now in particular to FIGS. 8 through 14, the details of drum 52 will be described. Drum 52 is provided with a plurality of circumferentially arranged forward flights 130 which are preferably oriented such that they extend inwardly from the inner surface 132 in a radial direction thereby forming a 90° angle with the tangential direction of rotation R. Flights 130 are oriented in this manner so as to lift the asphalt paving material which collects in the lower portion of the drum 52 and drop it through the central portion of the hot gas stream formed by burners 92 and 94. It is preferred that the major part of the asphalt material slide off flights 130 between the 11 o'clock and 1 o'clock positions so as to drop through the greatest distance and receive maximum exposure to the hot gases.

As the material is continuously raised and then dropped through the hot gas stream, it will be conveyed rearwardly at a rate which is a function of the angle of tilt of drum 52. Obviously, the greater the degree of tilt, the faster the material will be conveyed towards the discharge opening 98. A plumb 132 is mounted on inlet box 76 for swinging movement, and since it will always hang vertically, the degree of tilt may be determined by observing which of the graduations 134 is aligned with the pointer. It will be noted that certain ones of flights 130 are provided with longitudinal lips 136 which results in slowing the flow of some of the material and rendering the effect of a longer drum.

Extending from the forward ends of flights 130 to drum flange plate 70 are flights 138. These are angled in a direction toward the direction of rotation so as to assist in pulling the paving material from the inlet chute 74.

Figure 8:
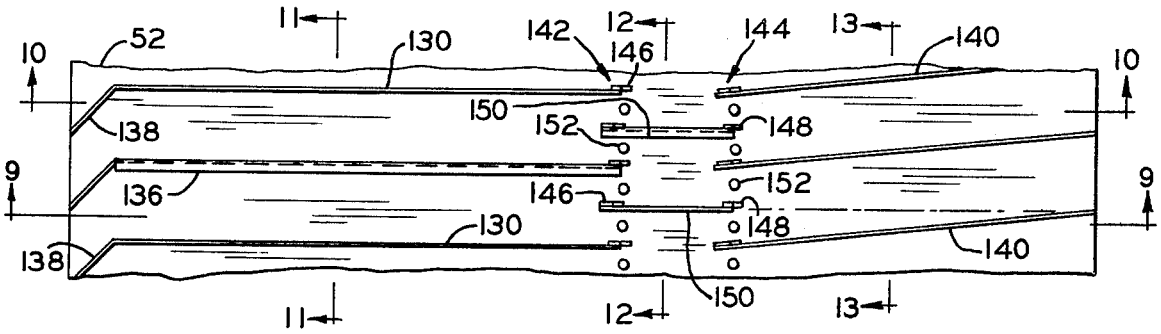
FIG. 8 is a longitudinal sectional view of the mixing drum showing the details of the flights mounted on the internal surface thereof.
Figure 9:
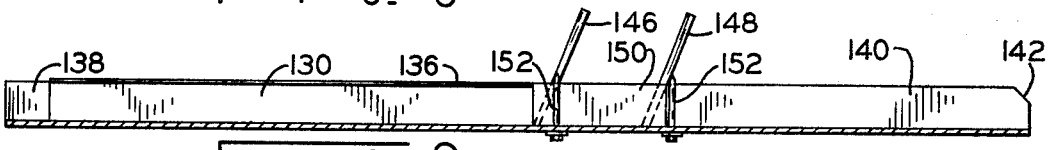
FIG. 9 is a longitudinal sectional view taken along line 9—9 of FIG. 8 and viewed in the direction of the arrows.
Figure 10:
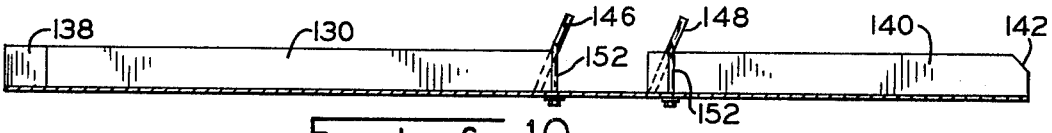
FIG. 10 is a longitudinal sectional view taken along line 10—10 of FIG. 8 and viewed in the direction of the arrow.
Figure 11:
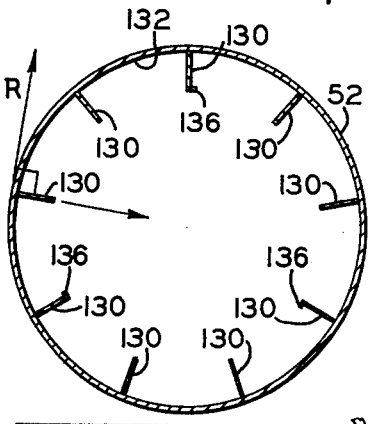
FIG. 11 is a transverse sectional view taken along line 11 and viewed in the direction of the arrow.
Figure 13:
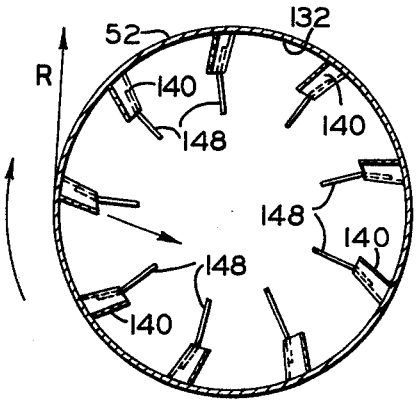
FIG. 13 is a transverse sectional view taken along line 13 and viewed in the direction of the arrow.
Figure 14:
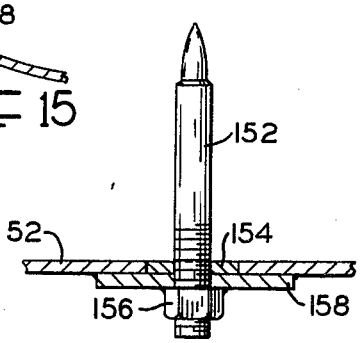
FIG. 14 is an enlarged fragmentary view showing the details of one of the inwardly projecting spikes.

Disposed rearwardly of flights 130 are a second set of flights 140 which are circumferentially arranged and extend to the rear of drum 52. Unlike flights 130, however, flights 140 are angled in two directions as shown in FIGS. 8 and 13. Flights 140 extend inwardly from the inner surface 132 of drum 52 at an angle to the radial direction and more specifically at an obtuse angle to the tangential direction of rotation R. This causes the paving material to be dropped from the flights 140 sooner than it is dropped from the forward flights 130 so that instead of passing through the central portion of the hot gas stream or the flame itself, it is merely dropped to the next succeeding flight 140. Although the paving material will continue to be heated, the outer surface will not be subjected to the very high temperature of the flame which is likely to cause oxidation and burning, both of which are deleterious to the properties of the asphalt. In addition to being canted at an angle to the radial direction, flights 140 are inclined with respect to the longitudinal direction so as to convey the paving material rearwardly more rapidly in the flame zone. As shown in FIGS. 9 and 10, the rear corners 142 of flights 140 may be chamfered so as to cause the material to drop even further away from the flame.

Positioned between flights 130 and 140 are a pair of rotating grizzlies 142 and 144 which comprise a plurality of circumferentially arranged bars 146 and 148, respectively, that extend inwardly further than flights 130 and 140 and are inclined rearwardly at an angle of approximately 60° to the horizontal direction. A third set of flights 150 are positioned between the two sets of bars 146 and 148 and are offset from flights 130 and 140. Like flights 130, they serve to raise the paving material and drop it centrally through the hot gas stream. Bars 146 and 148 function to retard the flow of chunks of paving material while at the same time permitting smaller particle-size materials to be conveyed rearwardly. As the larger chunks are retarded, they will be broken up by flights 130 and 150 and also to a certain extent by bars 146 and 148. Once the chunks have been reduced to a sufficiently small size, they will pass through grizzlies 142 and 148 and be conveyed rearwardly to discharge opening 96 by rear flights 140.

Figure 12:
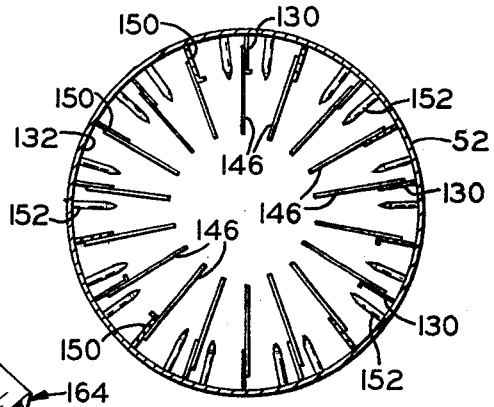
FIG. 12 is a transverse sectional view taken along line 12 and viewed in the direction of the arrow.

A plurality of sharpened spikes 152 project inwardly as shown in FIG. 12 and serve to further assist in breaking up chunks of material as they pass between the grizzlies 142 and 144. Spikes 152 are threaded into bushings 154 and are locked by means of nut 156 which is welded to plate 158. As spikes 152 become dulled, they may be removed for sharpening or replaced altogether.

In order to provide heat insulation and to protect the operator from being burned by coming into contact with drum 52, it is provided with a shroud 160 and a rear cover 162.

In operation, the apparatus may be towed to the site where the repairs are to be made by a truck containing the cold mix asphalt. On arrival, the discharge tray 100 is lowered and the drum 52 is tilted to an inclined position relative to the horizontal by turning crank 50. The apparatus in this position is shown in FIG. 4.

Main shut off valve 112 is opened and then pilot burner 96 is lighted and the flame regulated by means of pilot valve 118. Valve 116 is then opened and valves 117 and 119 are adjusted for proper flame control thereby causing gas to be emitted from main burners 92 and 94 which in turn is ignited by pilot burner 96. With engine 66 started, drum 52 will rotate and as material is shoveled or otherwise fed to feed chute 74, it will force door 80 open and slide downwardly onto inclined flights 138. Flights 138 will convey the material rearwardly where it is continuously raised and dropped through the central portion of drum 52 and therefore through the hottest portion of the hot gas stream by flights 130. Each time the material is dropped, it will be conveyed rearwardly due to the inclination of drum 52. The smaller particles will pass through grizzlies 142 and 144 with little resistance and by this time they will have been heated very near to the optimum temperature. As the material is raised by inclined flights 140, it will be conveyed rearwardly at a faster rate than previously due to the longitudinal inclination of the flights 140. Since flights 140 are canted from the radial direction, the material will be dropped at a point which is peripheral to the hot gas stream and away from the flames. The material is conveyed rearwardly through discharge opening 98 where it drops onto tray 100 and from there it may be shoveled or poured in the holes which are to be repaired.

Since the interior of drum 52 is nearly completely enclosed by rear cover plate 88, inlet box 76 and stack damper 86, the oxygen content of the surrounding atmosphere may be maintained at a relatively low level thereby preventing oxidation and burning yet permitting the asphalt material to be heated to the proper temperature. Sensor 120 and modulating valve 122 serve to regulate the drum temperature by controlling the supply of gas to main burners 92 and 94. Discharge temperatures may range from 200° F. to 260° F. for different cold mix compounds.

The apparatus is also capable of recycling hardened asphalt which is removed from a road surface. For example, the apparatus may be towed to a location where repairs are necessary and as the asphalt is stripped from a road surface, it is placed in the apparatus in chunk form. If desired, a certain amount of cold mix asphalt, liquid asphalt and/or aggregates may be added if necessary to obtain a proper mixture. This material will then be processed in the same fashion as for the cold mix except that it is preferably discharged at a temperature of at least 270° F. On discharge, the processed material may be replaced in the same area of the road from which it was removed.

In recycling asphalt materials, preservation of the additives is necessary as opposed to cold mix, where the additives must be driven off. Accordingly, an oxygen starved atmosphere to minimize oxidation and the avoidance of direct flame contact are essential.

The apparatus described above does not require a great deal of sophisticated control and regulation. For example, if the operator is able to see and smell smoke when the asphalt is discharged from the drum, he merely turns the controls down until the smoke disappears. If the material begins to burn within the drum 52, the stack damper 86 may be closed further in order to reduce the oxygen content within the drum. The degree of tilt and the speed at which the drum rotates may also be easily adjusted by observing the manner in which the material drops off the flights and is conveyed rearwardly.

Figure 15:
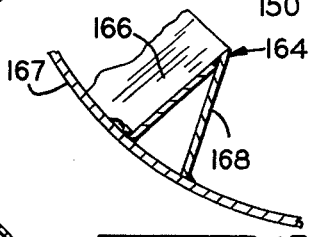
FIG. 15 is a fragmentary sectional view of an alternative flight construction.

In order to assist in preventing material buildup behind the rear flights, they may be constructed as shown in FIG. 15. In this construction, the flights 164 are triangular in cross section having a leading side 166 which is canted at some angle, for example 105°, to the tangential direction of rotation of the drum 167 similarly to flights 140, and a trailing side 168. Side 168 may be perpendicular to drum 167 or at an oblique angle, such as a 105° angle, thereto.

Although this invention has been described in terms of a specific apparatus, the description is made by way of example only and is not intended as a limitation to the scope of the invention.

What is claimed is:

1. Portable apparatus for treating asphalt paving material comprising:

a wheeled frame, an elongated drum having a cylindrical inner surface, an inlet at the forward end thereof and an outlet at the opposite rear end thereof, and being supported on said frame with its longitudinal axis extending lengthwise of said frame, means carried by said frame for rotating said drum in a given direction about its longitudinal axis, material feed means communicating with said inlet, burner means mounted at said drum outlet for directing a stream of hot gases centrally through said drum toward said forward end, means comprising a plurality of first flights secured to said drum inner surface for raising said asphalt paving material from the lower portion of said drum and then dropping said material in a vertical stream so that it passes through the stream of hot gases while at the same time conveying the material rearwardly at a first rate as said drum rotates, said vertical stream of material being spaced from said drum longitudinal axis by a first horizontal distance, and means comprising a plurality of second flights secured to said drum inner surface rearwardly of said first flights for raising asphalt paving material from the lower portion of said drum and then dropping said material in a vertical stream while at the same time conveying the material rearwardly at a faster rate than the first rate, said last-mentioned vertical stream of material being spaced from said drum longitudinal axis by a second horizontal distance, said second distance being greater than said first distance so that the material does not pass directly through the stream of hot gases in the rearmost portion of said drum.

2. The apparatus of claim 1 wherein:

said first flights extend radially inward from said drum inner surface at a non-obtuse angle to the tangential direction of rotation of said drum at the respective points where said first flights are secured to said drum inner surface, and said second flights extend inwardly from said drum inner surface at an obtuse angle to the tangential direction of rotation of said drum at the respective points where said second flights are secured to said drum inner surface.

3. The apparatus of claim 2 wherein said first and second flights are elongated and respectively circumferentially arranged.

4. The apparatus of claim 1 wherein said plurality of first flights are longitudinally spaced from said plurality of second flights, and including means comprising a plurality of projecting elements secured to said drum inner surface between said first and second flights for comminuting the paving material.

5. The apparatus of claim 4 wherein said elements include sharpened spikes extending radially inward toward said drum longitudinal axis.

6. The apparatus of claim 4 wherein said elements include a plurality of bars extending inwardly toward said drum longitudinal axis a greater distance than either said first or second flights.

7. The apparatus of claim 1 including means between said first and second flights for screening the paving material and preventing chunks above a given size from being conveyed rearwardly.

8. The apparatus of claim 1 including a plurality of third flights between said inlet and said first flights secured to said drum inner surface extending inwardly therefrom and extending longitudinally at an inclined angle relative to the drum longitudinal axis.

9. The apparatus of claim 1 and including means for adjustably sealing the interior of said drum so as to provide an oxygen starved atmosphere therein.

10. The apparatus of claim 9 wherein said means for adjustably sealing includes an exhaust stack, a damper in said exhaust stack and a balanced door in said inlet.

11. The apparatus of claim 1 and including a heat shielding shroud at least partially enclosing said drum.

12. The apparatus of claim 1 and including means for adjustably tilting said drum with respect to said frame.

13. The apparatus of claim 12 including plumb means for indicating the degree of tilt of said drum.

14. The apparatus of claim 1 including heat sensor means mounted at or near the forward end of said drum for automatically adjusting said burner means as a function of the temperature sensed.

15. The apparatus of claim 14 wherein said burner means comprises two main burners and a pilot burner, and said heat sensor means controls only said main burners.

16. Portable apparatus for treating asphalt paving material comprising:

a wheeled frame, an elongated drum having a cylindrical inner surface, an inlet at the forward end thereof and an outlet at the opposite rear end thereof, and being supported on said frame with its longitudinal axis extending lengthwise of said frame, means carried by said frame for rotating said drum about its longitudinal axis, material feed means communicating with said inlet, burner means mounted at said drum outlet for directing a stream of hot gases through said drum toward said forward end, a plurality of first flights on said drum inner surface extending radially inward toward the drum longitudinal axis and extending along said drum inner surface toward said rear end in a direction parallel to said drum longitudinal axis, and a plurality of elongated second flights on said drum inner surface extending inwardly from said drum inner surface and being canted off to one side of the drum radial direction in a rearward direction with respect to the drum tangential direction of rotation, said second flights extending along said drum inner surface toward the rear end of said drum respectively along non-converging axes which are inclined relative to said drum longitudinal axis, said first flights extending from a point at or near said forward end to a point intermediate said forward and rear ends, and said second flights extending from a point intermediate said front and rear ends to a point at or near said rear end.

17. The apparatus of claim 16 wherein said first and second flights overlap.

18. The apparatus of claim 16 wherein said first and second flights are longitudinally spaced apart.

19. The apparatus of claim 16 and including comminuting bars attached to said drum inner surface and extending inwardly and rearwardly therefrom, said comminuting bars being located between said first and said second flights.

20. The apparatus of claim 16 wherein said second flights are canted at an obtuse angle to the tangential direction of rotation of said drum at the respective points where said second flights are attached to said drum inner surface.

21. The apparatus of claim 20 wherein said angle is between 90° and 105°.

22. The apparatus of claim 21 wherein said angle is about 105°.

23. The apparatus of claim 16 wherein said second flights are triangular in transverse cross section having rearwardly facing surfaces with respect to the direction of rotation of said drum forming a nonobtuse angle with the tangential direction of rotation of said drum.

24. The method of recycling old asphalt paving material comprising:

removing the old asphalt paving material from a road surface or the like, providing a stream of hot gases capable of softening the asphalt material, tumbling the asphalt material in a rotating drum so that it passes through the center portion of the drum and the hot gas stream while at the same time conveying the asphalt material at a first rate generally toward the source of the hot gases, subsequently tumbling the asphalt material so that it passes through a more peripheral portion of the drum and at the same time conveying the material generally toward the source of the hot gases at a faster rate than the first rate, and discharging the softened asphalt material.

25. The method of claim 24 and including comminuting the paving material as it is conveyed rearwardly.

26. The method of claim 25 and retarding the flow of larger chunks of paving material rearwardly while permitting smaller chunks of paving material to flow relatively unimpeded.

27. The method of claim 24 wherein the paving material is tumbled through a horizontally inclined drum having a plurality of inwardly projecting flights.

28. The method of claim 27 wherein the paving material is tumbled by two sets of flights longitudinally displaced in the drum and the rearmost flights are inclined radially and longitudinally from the longitudinal axis of the drum.

29. The method of claim 24 wherein cold mix asphalt material is mixed with the removed asphalt paving material.

30. The method of claim 24 wherein an oxygen starved atmosphere is provided within the drum.

31. The method of claim 24 wherein liquid asphalt is mixed with the removed asphalt paving material.

32. The method of claim 24 wherein aggregate material is added to the removed asphalt paving material.

33. Portable apparatus for treating asphalt paving material comprising:

a wheeled frame, an elongated drum having a generally cylindrical inner surface, an inlet at the forward end thereof and an outlet at the opposite rear end thereof, and being supported on said frame with its longitudinal axis extending lengthwise of said frame, means carried by said frame for rotating said drum in a given direction about its longitudinal axis, material feed means communicating with said inlet, burner means mounted at said drum outlet for directing a stream of hot gases centrally through said drum toward said forward end, first flight means secured to said drum inner surface for raising paving material from the lower portion of said drum and then dropping it through the stream of hot gases at a first distance from said drum longitudinal axis while at the same time conveying the material rearwardly as said drum rotates, and second flight means secured to said drum inner surface rearwardly of said first flight means for raising paving material from the lower portion of said drum and then dropping it at a second horizontal distance from said drum longitudinal axis greater than said first radial distance while at the same time conveying the material rearwardly, said first flight means extending inward from said drum inner surface at a first angle to the tangential direction of rotation of said drum at the respective points where said first flight means are secured to said drum inner surface, and said second flight means extending inward from said drum inner surface at a second angle to the tangential direction of rotation of said drum at the respective points where said second flight means are secured to said drum inner surface, said second angle being greater than said first angle such that the point in the rotation of said drum at which the paving material is dropped by said second flight means is lower than the point in the rotation of said drum at which the paving material is dropped by said first flight means.

34. The apparatus of claim 33 wherein said first and second flight means comprise a plurality of radial flights, and including a plurality of circumferentially spaced comminuting bars attached to said drum inner surface and extending inwardly a substantially greater distance than said first and second flight means, said bars being angled rearwardly toward the rear end of said drum.

* * * * *

UNITED STATES PATENT AND TRADEMARK OFFICE

CERTIFICATE OF CORRECTION

PATENT NO. : 4,130,364

DATED : December 19, 1978

INVENTOR(S) : Ralph E. Brown

It is certified that error appears in the above–identified patent and that said Letters Patent are hereby corrected as shown below:

IN THE CLAIMS:

Claim 33, col. 12, line 50, insert -- horizontal -- before "distance".

Claim 33, col. 12, line 59, delete "radial".

Signed and Sealed this

*First* Day of *May 1979*

[SEAL]

*Attest:*

RUTH C. MASON
*Attesting Officer*

DONALD W. BANNER
*Commissioner of Patents and Trademarks*